US009099782B2

(12) United States Patent
Ziolkowski

(10) Patent No.: US 9,099,782 B2
(45) Date of Patent: Aug. 4, 2015

(54) LIGHTWEIGHT, MULTIBAND, HIGH ANGLE SANDWICH RADOME STRUCTURE FOR MILLIMETER WAVE FREQUENCIES

(75) Inventor: Fredric Paul Ziolkowski, South Grafton, MA (US)

(73) Assignee: CPI Radant Technologies Division Inc., Stow, MA (US)

( * ) Notice: Subject to any disclaimer, the term of this patent is extended or adjusted under 35 U.S.C. 154(b) by 54 days.

(21) Appl. No.: 13/506,968

(22) Filed: May 29, 2012

(65) Prior Publication Data

US 2013/0321236 A1 Dec. 5, 2013

(51) Int. Cl.
*H01Q 1/42* (2006.01)

(52) U.S. Cl.
CPC ..... *H01Q 1/424* (2013.01)

(58) Field of Classification Search
CPC ..... H01Q 1/42; H01Q 1/422
USPC ..... 343/872
See application file for complete search history.

(56) References Cited

U.S. PATENT DOCUMENTS

| | | | | |
|---|---|---|---|---|
| 3,115,271 | A | 12/1963 | Anderson et al. | |
| 3,780,374 | A | 12/1973 | Shibano et al. | |
| 4,212,014 | A | 7/1980 | Chekroun | |
| 4,297,708 | A | 10/1981 | Vidal | |
| 4,320,404 | A | 3/1982 | Chekroun | |
| 4,344,077 | A | 8/1982 | Chekroun et al. | |
| 4,358,772 | A * | 11/1982 | Leggett | 343/872 |
| 4,433,313 | A | 2/1984 | Saint et al. | |
| 4,447,815 | A | 5/1984 | Chekroun et al. | |
| 4,467,330 | A | 8/1984 | Vidal et al. | |
| 4,506,269 | A | 3/1985 | Greene | |
| 4,518,966 | A | 5/1985 | Sadones | |
| 4,531,126 | A | 7/1985 | Sadones | |
| 4,552,151 | A | 11/1985 | Bolomey et al. | |
| 4,656,487 | A | 4/1987 | Sureau et al. | |
| 4,684,954 | A | 8/1987 | Sureau et al. | |
| 4,783,666 | A * | 11/1988 | Ast et al. | 343/872 |
| 4,864,321 | A | 9/1989 | Sureau | |
| 5,001,495 | A | 3/1991 | Chekroun | |
| 5,017,939 | A | 5/1991 | Wu | |
| 5,081,465 | A | 1/1992 | Collignon | |
| 5,144,327 | A | 9/1992 | Chekroun et al. | |
| 5,237,328 | A | 8/1993 | Dorey et al. | |
| 5,408,244 | A * | 4/1995 | Mackenzie | 343/872 |
| 5,574,471 | A | 11/1996 | Sureau | |
| 5,579,015 | A | 11/1996 | Collignon | |
| 5,579,024 | A | 11/1996 | Sureau | |
| 5,598,172 | A | 1/1997 | Chekroun | |
| 5,621,423 | A | 4/1997 | Sureau | |
| 6,028,565 | A * | 2/2000 | Mackenzie et al. | 343/872 |
| 6,107,976 | A | 8/2000 | Purinton | |
| 7,420,523 | B1 | 9/2008 | Ziolkowski et al. | |
| 7,463,212 | B1 * | 12/2008 | Ziolkowski | 343/872 |
| 8,599,095 | B2 | 12/2013 | Wu | |
| 2013/0040098 | A1 * | 2/2013 | Hooker et al. | 428/116 |

OTHER PUBLICATIONS

U.S. Appl. No. 13/135,263, Ziolkowski et al.

(Continued)

*Primary Examiner* — Dameon E Levi
*Assistant Examiner* — Hasan Islam
(74) *Attorney, Agent, or Firm* — Iandiorio Teska & Coleman, LLP

(57) ABSTRACT

A lightweight multiband, high angle sandwich radome structure for millimeter wave frequencies includes a central core layer, a reinforced laminate skin adjacent each side of the central core, and outer matching layers on each of the reinforced laminates.

8 Claims, 4 Drawing Sheets

(56) References Cited

OTHER PUBLICATIONS

R.H.J. Cary, *Radomes*, in The Handbook of Antenna Design, vol. 2, Chapter 14, (A.W. Rudge et al. eds., 1983). Peter Peregrinus Ltd. on behalf of the Institution of Electrical Engineers, London, UK (pp. 457-552).

Publication entitled "Skolnik Radar Handbook," Ch.14, sections 14.1-14.3, pp. 14-2-14-21 (date unknown).

Skolnik, M.I., Introduction to Radar Systems, Chapter 7 (1980, 2nd Edition), McGraw-Hill, Inc., New York, NY, pp. 264-269.

* cited by examiner

LIGHTWEIGHT, MULTIBAND, HIGH ANGLE SANDWICH RADOME STRUCTURE FOR MILLIMETER WAVE FREQUENCIES

FIELD OF THE INVENTION

This invention relates to an improved, lightweight, multiband, high angle sandwich radome structure for millimeter wave frequencies.

BACKGROUND OF THE INVENTION

Airborne satellite communication links are currently being developed for millimeter wave (K-Ka band) frequencies in order to achieve the broad bandwidths for high data rates. The K-Ka band frequencies require a radome wall design that differs radically from the thin laminate skin, low density core, sandwich design that has prevailed since World War II. For example, the thin-skin A-sandwich design for single band, centimeter wavelength airborne radomes has a typical thickness of about 0.3", an areal weight of about 0.5 pounds per square foot (PSF), and a transmission efficiency of about 95 percent. Designs for multiband, millimeter wavelength radomes require a nominal half-wave solid laminate core with outer, quarter wave matching layers; this achieves acceptable structural and electrical performance, particularly for low profile shapes that incur high incidence angles. The thickness of these designs is about 0.25", but their areal weight increases to 1.5 to 2.5 PSF and the transmission efficiency decreases to 80 to 60 percent. The basic multi-layer design for millimeter wavelength radomes has three layers; the addition of a fourth interior matching layer increases the minimum transmission efficiency of the multi-layer design from 60 percent to about 75 percent for the worst cases, but does not reduce the weight. The basic 3-layer, B-sandwich has received a U.S. Pat. No. 7,420,523, B1, dated 2 Sep. 2008, and assigned to Radant Technologies, Inc. and a 4-layer design is disclosed in a U.S. patent application Ser. No. 13/135,263 filed by Radant Technologies, Inc. on 30 Jun. 2011 both of which are incorporated herein in their entirety by this reference. The light weight configuration that is described in the following summary for K-Ka band radome designs also has application to Ku-K-Ka band radome designs.

SUMMARY OF THE INVENTION

It is therefore an object of this invention to provide an improved, lightweight, multiband, high angle sandwich radome structure for millimeter wave frequencies.

It is a further object of this invention to provide such an improved, sandwich radome structure which may decrease the areal weight by as much as 20-30%.

It is a further object of this invention to provide such an improved, sandwich radome structure which can maintain or improve transmission and cross polarization performance.

It is a further object of this invention to provide such an improved, sandwich radome structure which may use an A sandwich or even a C sandwich core.

It is a further object of this invention to provide such an improved, sandwich radome structure which allows for a balance between stiffness and weight.

It is a further object of this invention to provide such an improved, sandwich radome structure which is applicable not only to airborne deployment but to shipboard and terrestrial deployment as well.

The invention results from the realization that an improved lightweight, multiband, high angle sandwich radome structure for millimeter wave frequencies can be achieved with a central core layer, a reinforced laminate skin adjacent each side of the central core, and outer matching layers on each of the reinforced laminates.

This invention features a lightweight multiband, high angle sandwich radome structure for millimeter wave frequencies including a central core layer, a reinforced laminate skin adjacent each side of the central core, and outer matching layers on each of the reinforced laminates.

In preferred embodiment there may be a matching interior layer. The central core layer may be a lightweight, low density material. The thickness of each layer may be a multiple of a quarter wavelength at approximately the center frequency over the incidence angle range of the radome frequency range. The thickness of the radome structure may be a multiple of a quarter wavelength at approximately the center frequency over the incidence angle range of the radome frequency range. The central core layer may include a honeycomb material with a 2 PCF to 7 PCF density and a relative dielectric constant range of 1.03 to 1.15. The central core layer may include a syntactic film material with a density of 32 to 42 PCF and a relative dielectric constant range of 1.6 to 2.3. The central core layer may include a laminate with high modulus polypropylene fabric with a density of about 63 PCF and a relative dielectric constant range of 2.2 to 2.7. The central core layer may include a quartz laminate with a 100 to 110 PCF density and a relative dielectric constant range of 3.0 to 3.6. The laminate skins may include an E-glass woven fabric reinforcement and a thermo-set resin. The laminate skins may include a quartz woven fabric reinforcement and a thermo-set resin. The laminate skins include a woven fabric reinforcement that is a combination of HMPP and E-glass materials with a total thickness of approximately 25 mils and a thermo-set resin. The outer matching layers may include thermo-set resin and glass bubbles with a relative dielectric constant in the range of 1.6 to 2.3. The interior matching layers may include a very low density material with a density from 5 to 9 PCF including thermoset and thermoplastic foams with air comprising 93 percent to 85 percent of the volume.

This invention also features a lightweight, multiband, high angle sandwich radome structure for millimeter wave frequencies including an A sandwich radome core, and an outer matching layer on each side of the A sandwich radome core.

In preferred embodiments the A sandwich radome core may include a lightweight, low density material sandwiched between laminate skins. There may be a matching interior layer. The thickness of each layer may be a multiple of a quarter wavelength at approximately the center frequency over the incidence angle range of the radome frequency range. The thickness of the radome structure may be a multiple of a quarter wavelength at approximately the center frequency over the incidence angle range of the radome frequency range.

This invention also features a lightweight, multiband, high angle sandwich radome structure for millimeter wave frequencies including a C sandwich radome core, and an outer matching layer on each side of the C sandwich radome core.

In preferred embodiments C sandwich radome core may include two sections of lightweight, low density material sandwiched between three laminate skins. There may be a matching interior layer. The thickness of each layer may be a multiple of a quarter wavelength at approximately the center frequency over the incidence angle range of the radome frequency range. The thickness of the radome structure may be a multiple of a quarter wavelength at approximately the center frequency over the incidence angle range of the radome frequency range.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
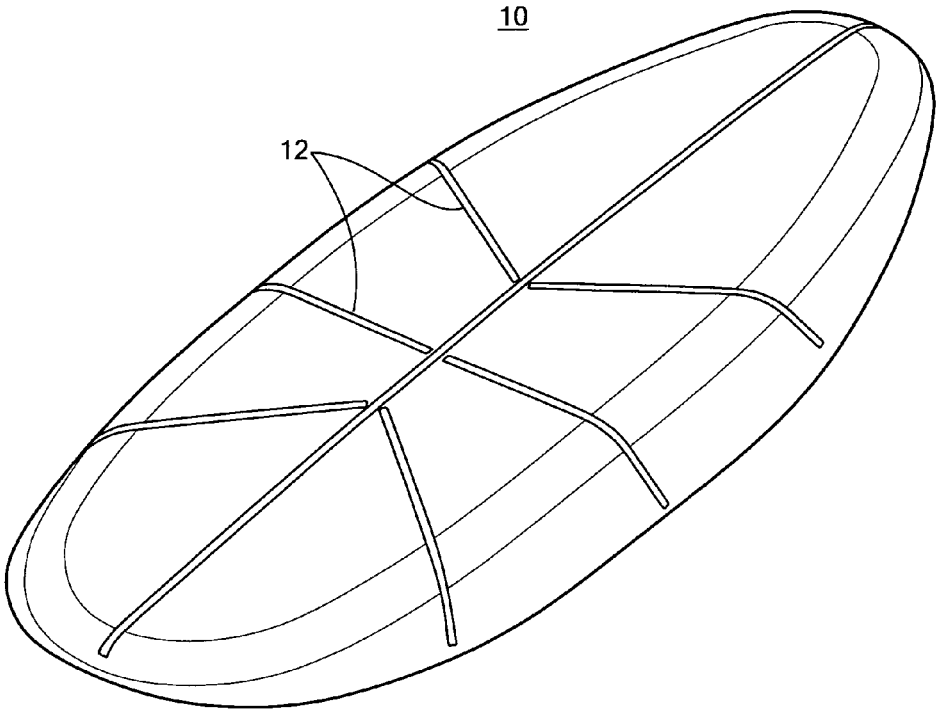
FIG. 1 is a three dimensional view of a high incidence angle, multiband, sandwich radome to which this invention may be applied.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

In accordance with various embodiments of the lightweight, multiband, high angle sandwich radome structure for millimeter weight frequencies according to this invention a typical dense central layer that is nominally one half wavelength thick is replaced by a core of low density material nominally either one or a multiple quarter wavelength thick, which may be an A sandwich for example. The combination of the reduced thickness and lower density core material reduces the weight by 20 to over 30% while maintaining the transmission and the cross-polarization performance. In one embodiment of this invention the improved lightweight configuration of the basic 3-layer design has five layers, in another the improved lightweight configuration of the basic 4-layer design has six layers. The balance is between stiffness and weight. The radome structure of this invention is applied here in airborne applications but is also applicable for other uses, e.g. shipboard and terrestrial radomes. The central core layer of the conventional 3-layer and 4-layer structures may also be replaced by a C sandwich which then, respectively, creates a 7-layer and an 8-layer structure which can improve the stiffness but increases the weight somewhat.

There is shown in FIG. 1 one particular shape of radome 10 typically used in airborne applications with the radome structure of this invention and having a shape of a rounded teardrop flattened on top. The spider like conductor network 12 is a lightning diversion device that forms no part of the invention.

Figure 2:
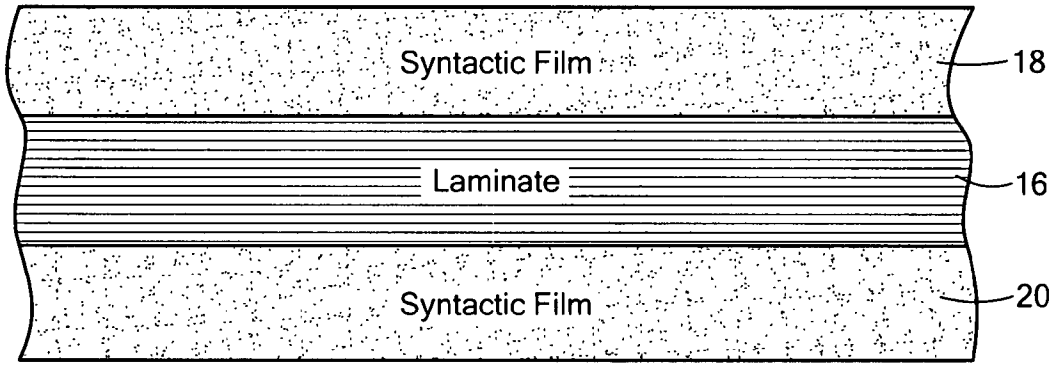
FIG. 2 (PRIOR ART)
FIG. 2 is a side cross-sectional diagrammatic view of a prior art, three layer radome sandwich structure.

A basic 3-layer radome structure 14, FIG. 2, includes two types of materials, a central core layer 16 of reinforced laminate or quartz fabric reinforced laminate and outer matching layers 18 and 20 of syntactic film. Multiband millimeter wave structures for commercial radomes usually use E-glass fabric laminates because of their lower cost: military applications usually favor quartz laminate cores because of the improved electric performance even though the core material cost may be considerably greater. Commercial radome structures usually place more importance on lighter-weight. The binding agents for both types of laminates may be either a thermo-set epoxy resin or a cyanate ester thermoset resin. The syntactic film may be a mixture of similar resins and glass bubbles. It can be rolled into sheets that are conformable to any radome mold and can be co-cured with the laminate.

Figure 3:
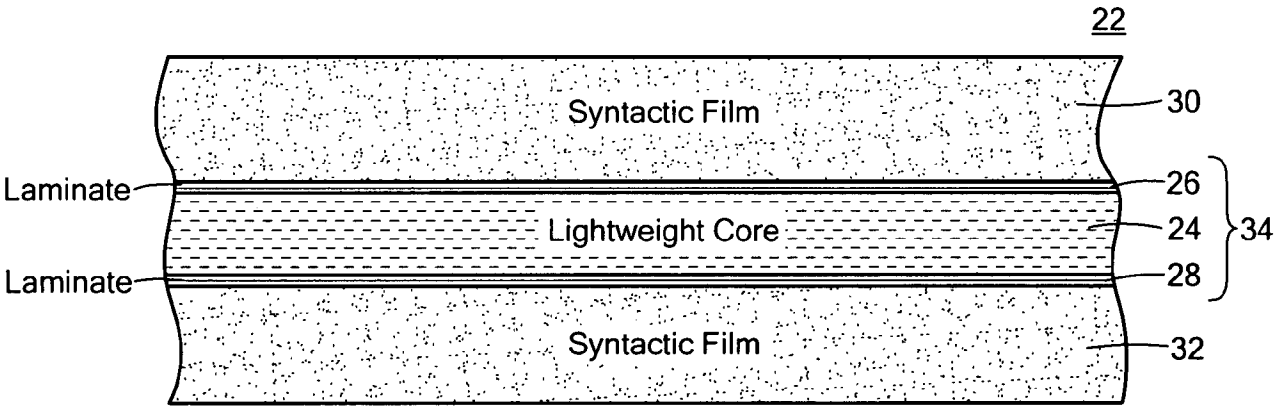
FIG. 3 is a side cross-sectional diagrammatic view of an improved five layer radome sandwich structure according to this invention.

A 5-layer light weight radome structure according to this invention 22, FIG. 3, includes a central core layer 24, reinforced laminate skins 26 and 28 adjacent each side of the central core layer 24 and outer matching layers 30 and 32. The assembly of core 24 and skins 26 and 28 may also be implemented with an A-sandwich structure. The lightweight central core layer 24 may be made of a number of different materials such as very low density 4 PCF honeycomb core, low density 36 PCF syntactic film, moderate density 65 PCF laminate with high modulus polypropylene (HMPP) fabric or equivalent polyethylene fabric with woven fiber, with bundled fiber, with meshed fiber, or with woven strip reinforcement, and sometimes a high density 105 PCF quartz fabric laminate. Skins 26 and 28 may be made of a laminate with stiffer, higher modulus E-glass or quartz fabric reinforcement, and outer matching layers 30 and 32 may be a syntactic film as referred to earlier.

Figure 4:
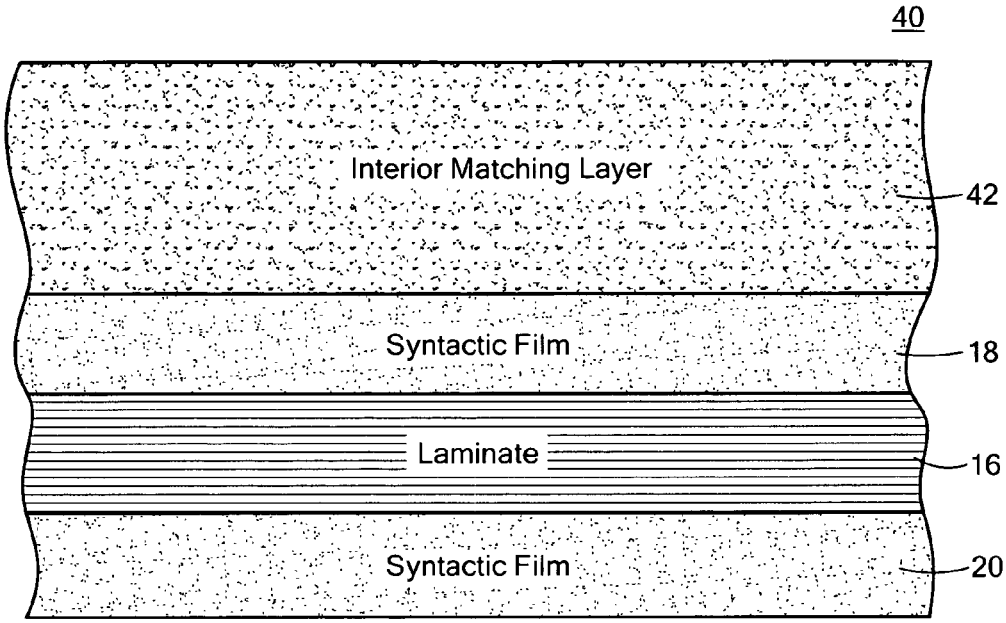
FIG. 4 (PRIOR ART)
FIG. 4 is a side cross-sectional diagrammatic view of a prior art four layer radome sandwich structure.

A typical 4-layer design 40, FIG. 4, includes the same structure of central core layers laminate 16 with syntactic films 18 and 20 but in addition has an interior matching layer 42 which may be made of a low density (7 PCF) material with a relative permittivity near 1.15 that is preferably flexible at room temperature, but may be rigid and require heat and pressure to conform to the radome shape.

Figure 5:
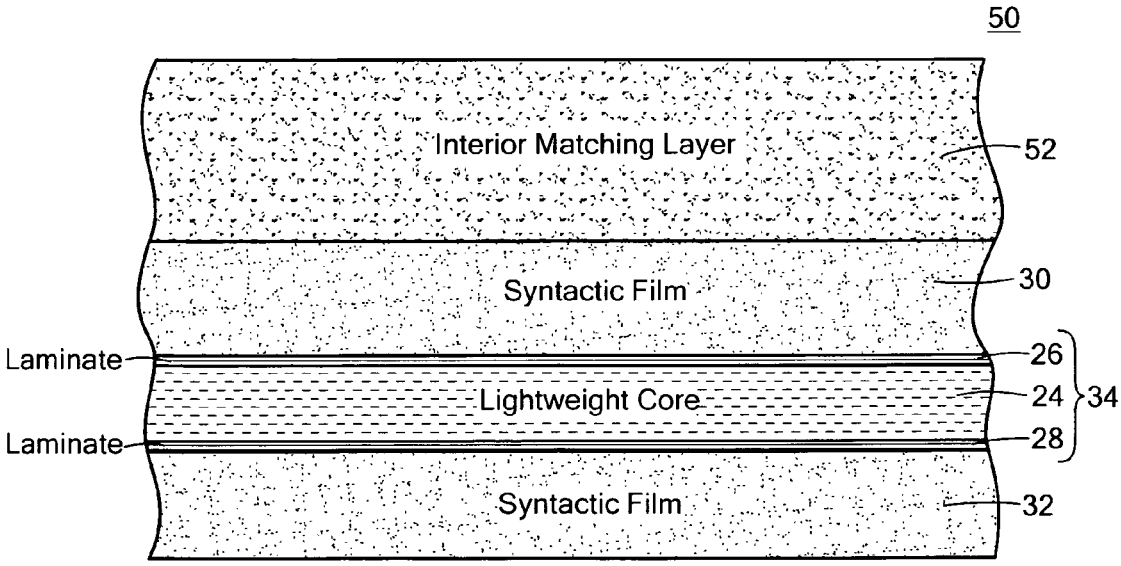
FIG. 5 is a side cross-sectional diagrammatic view of an improved six layer radome sandwich structure according to this invention.

In contrast the lightweight 6-layer radome structure of this invention 50, FIG. 5, includes central core layer 24, adjacent reinforced laminate skins 26 and 28 and outer matching layers 30 and 32 plus an interior matching layer 52 made of for example, low density (7 PCF) material with a relative permittivity near 1.15 that is preferably flexible at room temperature, but may be rigid and require heat and pressure to conform to the radome shape.

The material parameters for radome structures that have been described are summarized in Table 1. These include the density (PCF), the relative dielectric constant Er=Er' (1-j tand), and Young's modulus (Ym for msi=$10^6$ psi units) which is a measure of the stiffness of the material. The E-glass and quartz laminates are the most dense, most stiff, and have the highest relative dielectric constant which impairs the radome transmission; the 7781 and 4581 designations of Table 1 refer to the weave style of the E-glass or quartz fabric reinforcing the laminate, namely a satin weave style that most readily conforms to the compound curvature of most radome shapes.

TABLE 1

Nominal Material Physical and Electrical Parameters For Performance Calculations of Airborne Millimeter Wave, Light Weight Radomes

| Material | PCF | Er' | tand | Ym-msi |
|---|---|---|---|---|
| 7781 E-Glass Laminate | 110-120 | 4.4 | 0.013 | 3.8 |
| 4581 Quartz Laminate | 100-110 | 3.2 | 0.007 | 3.8 |
| HMPP Laminate | 63 | 2.5 | 0.010 | ~0.1 |
| Syntactic Film | 36 | 1.8 | 0.010 | 0.3 |
| Interior Matching | 7 | 1.15 | 0.004 | 0 |
| Honeycomb | ~4 | 1.08 | 0.003 | ~0.01 |

The lighter materials of Table 1 have the lowest relative dielectric constant and the highest transparency, but contribute less to the stiffness of the radome. The basic multiple layer designs have the highest relative dielectric materials at the center, with layers of decreasing relative dielectric constant materials toward the outer surfaces. Typically, the thickness of the central laminate core must be one-half wave length at the center frequency; the matching layers are nominally one-quarter wavelength. Broad band, high angle transmission is obtained because of internal cancellation of the reflections from the different layers for a wide range of frequencies and a wide range of incidence angles. The central core of the light weight designs deviates from this pattern. A thin skin A-sandwich achieves best transparency for a nominal quarter wave thickness, whereas a solid laminate requires half wave thickness; equivalent transmission is achieved with a thinner, lighter A-sandwich core.

Figure 6:
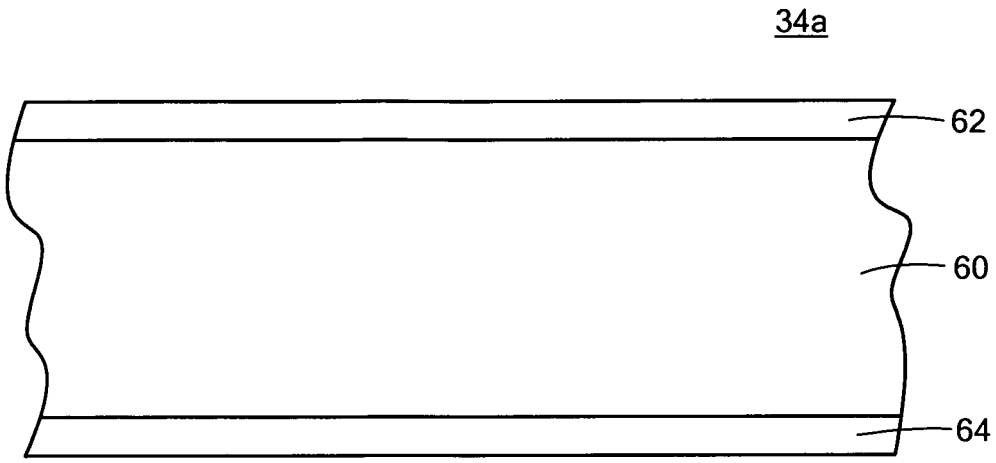
FIG. 6 is a side cross-sectional diagrammatic view of an A sandwich radome structure that can be used in this invention.
Figure 7:
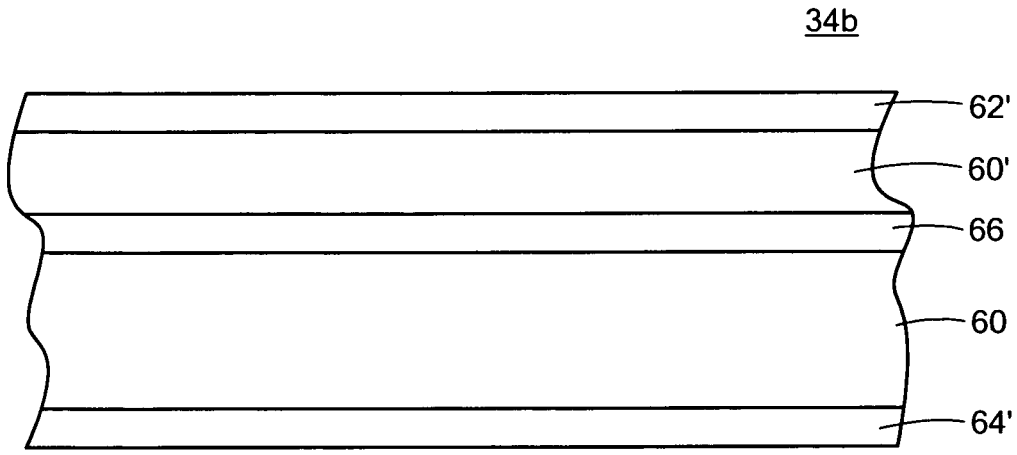
FIG. 7 is a side cross-sectional diagrammatic view of a C sandwich radome structure that can be used in this invention.

Although the central core layer has been indicated as alternatively constructed as an A sandwich structure, it may also be a C-sandwich structure. A typical A-sandwich structure 34*a*, FIG. 6, includes typically a foam core 60 made of a low density (2.5 to 8.5 PCF) honeycomb or foam material typically rigid at room temperature that must co-cure at 250° F. or 350° F. with the laminate skins, with adjacent thin laminates 62, 64, on either side. The thin laminates may be made of a laminate with stiffer, higher modulus E-glass or quartz fabric reinforcement. A C-sandwich 34*b*, FIG. 7, may include two layers of core material 60 and 60', FIG. 7, made of for example a low density (2.5 to 8.5 PCF) honeycomb or foam material typically rigid at room temperature that must co-cure at 250° F. or 350° F. with the laminate skins, with skins 62', 64', and 66. Typically, although not necessarily, layers 62' and 64' may have equal thickness and material, and 60 and 60' may as well.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A light-weight, multi-band, high angle, multi-layer sandwich radome structure for millimeter wave frequencies comprising:

an A-sandwich core with a low density central core layer made of honeycomb surrounded by reinforced laminate skin layers;

a first syntactic film matching layer on one side of the core;

a second syntactic film matching layer on an opposite side of the core; and an interior matching foam layer, interior to the radome, on the second matching layer and having a thickness of % wavelength at approximately the center frequency over the incident angle range of the radome frequency range.

2. The radome structure of claim 1 in which said foam layer has a density of between 5-9 PCF.

3. The radome structure of claim 1 in which said central core layer has a 2 PCF to 7 PCF density and a relative dielectric constant range of 1.03 to 1.15.

4. The radome structure of claim 1 in which the first and second syntactic film matching layers include thermo-set resin and glass bubbles with a relative dielectric constant in the range of 1.6 to 2.3.

5. A light-weight, multi-band, high angle, multi-layer sandwich radome structure for millimeter wave frequencies comprising:

a C-sandwich core with two low density honeycomb central core layers separated by a reinforced laminate layer and surrounded by reinforced laminate skin layers;

a first syntactic film matching layer on one side of the core;

a second syntactic film matching layer on the opposite side of the core; and an interior foam matching layer, interior to the radome, on the second matching layer and having a thickness of ¼ wavelength at approximately the center frequency over the incident angle range of the radome frequency range.

6. The radome structure of claim 5 in which said foam matching layer has a density of between 5-9 PCF.

7. The radome structure of claim 5 in which each said central core layer has a 2 PCF to 7 PCF density and a relative dielectric constant range of 1.03 to 1.15.

8. The radome structure of claim 5 in which the first and second syntactic film matching layers include thermo-set resin and glass bubbles with a relative dielectric constant in the range of 1.6 to 2.3.

* * * * *